US005592264A

United States Patent [19]

Shigeta et al.

[11] Patent Number: 5,592,264

[45] Date of Patent: Jan. 7, 1997

[54] MAGNETIC BRUSH TYPE CHARGING DEVICE

[75] Inventors: Kunio Shigeta; Sachie Hosogoezawa; Masahiro Onodera, all of Hachioji, Japan

[73] Assignee: Konica Corporation, Japan

[21] Appl. No.: 390,631

[22] Filed: Feb. 17, 1995

[30] Foreign Application Priority Data

Feb. 23, 1994 [JP] Japan ..... 6-025479
Apr. 15, 1994 [JP] Japan ..... 6-077476

[51] Int. Cl.[6] ..... G03G 15/02

[52] U.S. Cl. ..... 399/175; 361/225

[58] Field of Search ..... 355/219, 222, 355/227; 250/324, 325, 326; 361/225, 229, 230

[56] References Cited

U.S. PATENT DOCUMENTS 5,351,109 9/1994 Haneda ..... 355/219
5,357,323 10/1994 Haneda et al. ..... 355/219
5,367,365 11/1994 Haneda et al. ..... 355/219
5,381,215 1/1995 Haneda et al. ..... 355/219

*Primary Examiner*—Fred L. Braun
*Attorney, Agent, or Firm*—Bierman and Muserlian

[57] ABSTRACT

In an magnetic brush charging apparatus, a following relation is satisfied, $\rho \leqq M/H \leqq 1.6\ \rho$, wherein H is a minimum gap distance (cm) between a cylinder and an image carrying member, ρ is a density (g/cm$^3$) of magnetic particles and M is an amount (g/cm$^2$) of magnetic particles existing in a nip region coming in contact with the image carrying member.

2 Claims, 7 Drawing Sheets

MAGNETIC BRUSH TYPE CHARGING DEVICE

BACKGROUND OF THE INVENTION

The present invention relates to an electrical charging device of a magnetic brush type for charging an image-forming object with electricity uniformly in an image forming apparatus such as an electrophotographic copying machine and a printer of an electrophotographic type.

In an image forming apparatus of an electrophotographic type, a corona electrical charging unit has generally been used for charging an image forming object such as a photoreceptor drum. In the corona electrical charging unit, high voltage is impressed on a discharge wire to generate a strong electric field around the discharge wire for gas discharge, and an image forming object ads orbs charged ions produced in the gas discharge to be charged with electricity.

The aforementioned corona electrical charging unit used in conventional image forming apparatuses of an electrophotographic type has an advantageous point that an image forming object is not damaged in the course of charging, because the image forming object does-not come into contact with the corona electrical charging unit during charging. However, the corona electrical charging unit has disadvantageous points that an electric shock and a leak are feared due to high voltage used and ozone generated in gas discharge is harmful for human bodies and it shortens life of the image forming object. Further, charging voltage by means of the corona electrical charging unit is unstable because it is affected greatly by temperature and humidity. In addition to the above, the corona electrical charging unit generates a noise that is caused by high voltage, and 5 seconds or more are needed after the input of high voltage to obtain stable charging voltage, which has been the greatest drawback for utilizing an image forming apparatus of an electrophotographic type as a communication terminal or an information processing equipment.

The cause of such many drawbacks of the corona electrical charging unit lies in the fact that charging is performed in gas discharge.

As an electrical charging device which does not perform gas discharge by means of high voltage as in a corona electrical charging unit, does not harm mechanically to an image forming object, and can charge electrically the image forming object, Japanese Patent Publication Open to Public Inspection No. 133569/1984 (hereinafter referred to as Japanese Patent O.P.I Publication) discloses an electrical charging device wherein magnetic particles are adsorbed on a cylindrical conveying carrier containing therein magnetic objects to become a magnetic brush which rubs the surface of an image forming object under impression of D.C. bias voltage so that charging may be performed.

The magnetic brush mentioned above can charge an image forming object electrically without damaging it because the magnetic brush is a flexible brush composed of magnetic particles, and it is more excellent than other charging units of a contact type such as a fur brush charging unit and a charging unit employing a conductive and elastic roll. However, even in the case of using a charging unit employing the magnetic brush mentioned above, uniform charging can not always be obtained and there have occurred some problems that magnetic particles are stuck to the image forming object.

With the background mentioned above, Japanese Patent O.P.I. Publication Nos. 21873/1992 and 116674/1992, for example, disclosed a magnetic brush type charging method wherein A.C. bias voltage containing D.C. components is impressed on a magnetic brush for charging an image forming object. According to the description in Japanese Patent O.P.I. Publication No. 21873/1992, the aforementioned A.C. bias voltage is established for charging so that its peak to peak voltage $V_{p-p}$ exceeds the threshold value for discharge of the magnetic brush, and preferable frequency of A.C. bias voltage is 100–500 Hz. Further, magnetic particles used are to be iron, iron oxide or ferrite particles whose particle size is 20–200 μm and specific resistance is $10^5$–$10^9$ Ω·cm, thereby uniform charging can be provided on the image forming object. According to the description in Japanese Patent O.P.I. Publication No. 116674/1992, it is preferable that a magnetic particle having a particle size of not more than 70 μm and not less than 30 μm, a specific resistance of not less than $10^5$ Ω·cm and not more than $10^{12}$ Ω·cm and a shape which is spherical to the utmost is used and a distance between a conveying carrier and an image carrier is in the range of 100–5000 μm for charging.

However, charging methods described in the aforementioned publications still have problems that uneven charging in the pattern of streaks or ring marks is caused on the surface of the image forming object due to a coarse bristle formed with magnetic particles, or magnetic particles are stuck to the image forming object. When temperature and humidity are low, in particular, magnetic particles tend to stick because their resistance becomes high.

SUMMARY OF THE INVENTION

An object of the present invention is to provide an electrical charging device of a magnetic brush type wherein the aforementioned problems in the conventional technologies are solved, uneven charging in the pattern of streaks or ring marks is not caused, and uniform charging can be performed at high speed.

Further object of the present invention is to provide an electrical charging device of a magnetic brush type wherein uneven charging sticking of magnetic particles to an image forming object are not caused, and uniform charging can be performed at high speed.

As a result of a thorough examination made for attaining the objects mentioned above, it was found that the uneven charging in the pattern of streaks or ring marks tends to occur under the following conditions.

① A magnetic brush on a sleeve for charging use is in uneven contact with an image forming object.

② Conditions of bristles of a magnetic brush are not uniform in the area where a magnetic brush on a sleeve for charging use leaves an image forming object.

Therefore, it was found out that it is possible to prevent uneven charging in the pattern of streaks or ring marks by uniformalizing the contact between a magnetic brush on a sleeve for charging use and an image forming object and by uniformalizing the conditions of bristles of the magnetic brush in the area where the magnetic brush leaves the image forming object.

The condition wherein uneven charging in the pattern of streaks or ring marks is not caused can be attained by the following constitution.

③ Bristles of the magnetic brush are sufficiently compressed in the nip area where the magnetic brush comes in contact with the image forming object.

④ Both the sleeve for charging use and the image forming object are rotated in the same direction.

⑤ A magnetic pole provided at the position where the sleeve for charging use faces the image forming object is located at the downstream side of the point where the sleeve for charging use is closest to the image forming object and within the nip area.

The reasons for the foregoing and conditions for attaining the above-mentioned Items ③–⑤ will be explained as follows.

When the following relation is satisfied on the assumption that the apparent density of magnetic particles constituting the magnetic brush is ρ (g/cm$^3$), an amount of existence of magnetic particles on the sleeve for charging use at the nip portion is M (g/cm$^3$), and the minimum clearance at the nip portion between the sleeve for charging use and the image forming object is H (cm), $$\rho \leqq M/H \leqq 1.6\ \rho$$

bristles of the magnetic brush are compressed sufficiently at the nip portion where the magnetic brush comes in contact with the image forming object, which squares with the condition of Item ③.

Further, when the following relation is satisfied on the assumption that the clearance between the sleeve for charging use and the thickness regulating member for the magnetic brush is DR (cm), $$0.8\ H \leqq DR \leqq 1.6\ H$$

bristles of the magnetic brush are compressed sufficiently at the nip portion where the magnetic brush comes in contact with the image forming object.

However, when the above-mentioned relations are satisfied, magnetic particles sometimes stick to the image forming object because the magnetic brush and the image forming object are compressed at the nip portion.

For preventing magnetic particles from sticking to the image forming object, the sleeve for charging use and the image forming object can be rotated in the same direction as in Item ④ and magnetic poles can be provided in the sleeve for charging use in the vicinity of the position where the bristles of the magnetic brush leave the nip portion so that the binding force for the magnetic particles may be enhanced.

However, when magnetic poles are provided in the sleeve for charging use in the vicinity of the position where the bristles of the magnetic brush leave the nip portion, the bristles of the magnetic brush become uneven at the area where the magnetic brush leaves the image forming object.

Therefore, a magnetic pole provided at the position where the sleeve for charging use faces the image forming object is located at the downstream side of the point where the sleeve for charging use is closest to the image forming object and within the nip area. Owing to this arrangement, the bristles of the magnetic brush become uniform at the area where the magnetic brush leaves the image forming object, and the magnetic particles can be prevented from sticking to the image forming object.

In addition to the foregoing, when the following relation is satisfied on the assumption that the nip width is L (cm), and the distance between the end of the nip portion at the downstream side and the position on the sleeve for charging use corresponding to the magnetic pole that is closest to the end of the nip portion at the downstream side is D (cm), $$L/2 \leqq D$$

the bristles of the magnetic brush become uniform at the area where the magnetic brush leaves the image forming object, which is preferable.

DETAILED DESCRIPTION OF THE PREFERRED EMBODIMENT

Figure 1:
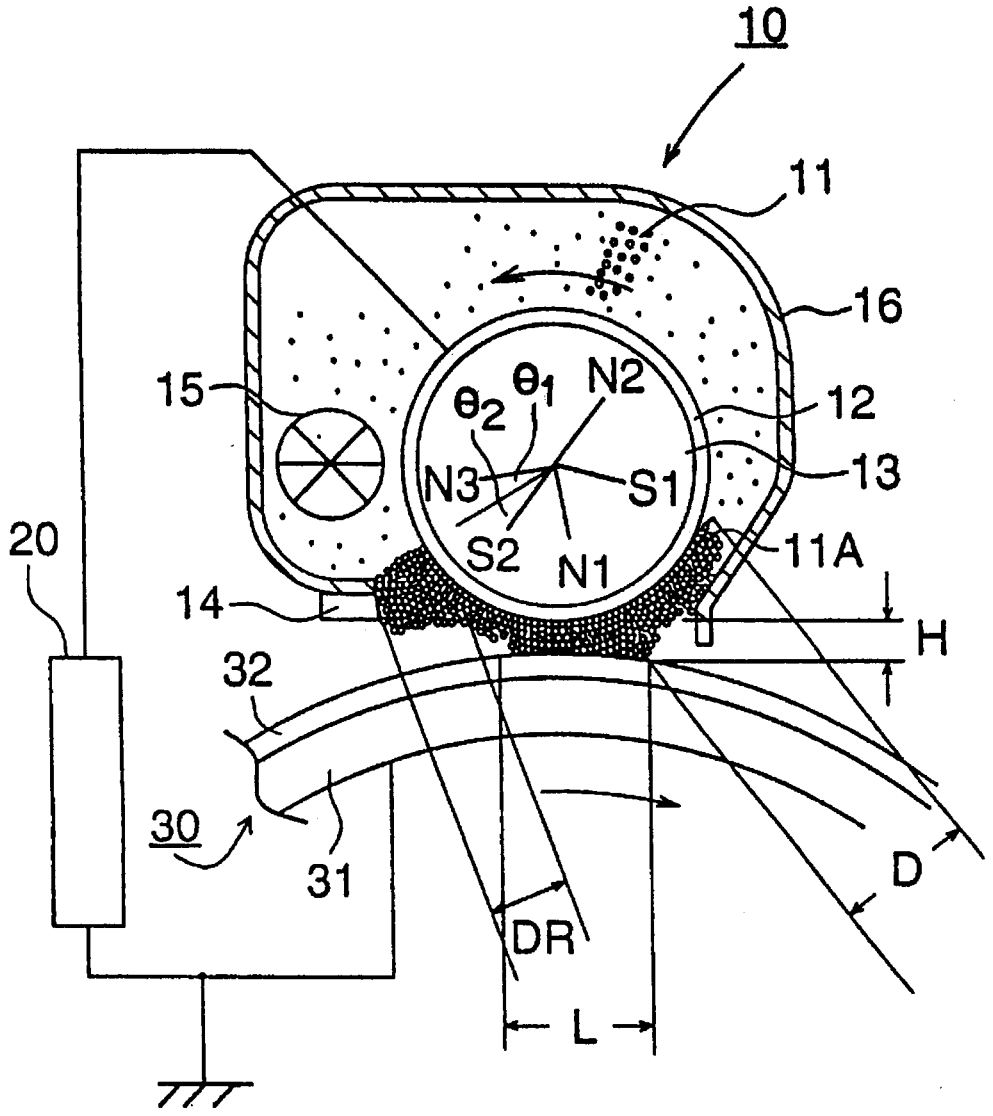
FIG. 1 is a sectional view showing an example of the electrical charging device of the invention.

FIG. 1 is a sectional view showing an example of electrical charging device 10 of the invention. In the figure, the numeral 11 represents magnetic particles, 11A is a magnetic brush, 12 is a charging sleeve which is a conveying carrier, 13 is a magnetic object, 14 is a regulating plate which is a regulating member, 15 is a stirring roller that is a stirring member, 16 is a casing, 20 is a power source as a bias-impressing means, 30 is a photoreceptor drum that is an image forming object wherein light-sensitive layer 32 is formed on conductive base 31, H is a minimum clearance at the nip area between the charging sleeve 12 and the photoreceptor drum 30, L is a nip width, and D is a distance between the ending point of the nip and the position on the conveying carrier corresponding to the center of a magnetic pole of the magnetic object that is located at the downstream side of the ending point of the nip and is closest to the ending point of the nip. $D_R$ represents a minimum clearance between the charging sleeve 12 and the regulating plate 14.

Charging sleeve 12 is a cylinder that has a diameter of 1 cm to 3 cm and is made of non-magnetic and conductive metal such as, for example, aluminum or stainless steel, and the charging sleeve is processed so that its surface roughness is 1 μm–30 μm. Inside the charging sleeve 12, there is affixed cylindrical magnetic object 13 having 4–12 magnetic poles each magnetized to N-pole or S-pole so that the magnetic field on the surface of the charging sleeve 12 may show 500–1,200 gauss, and the charging sleeve 12 can rotate independently from the magnetic object 13.

Casing 16 is a casing made of insulating resin such as, for example, acryl or polycarbonate, and inside the casing 16, there are provided charging sleeve 12 housing the above-mentioned affixed magnetic object 13 and the stirring roller 15, while at the outlet of the casing 16, there is arranged regulating plate 14.

Inside the casing 16, there are housed magnetic particles 11 whose apparent density is ρ, and the magnetic particles 11 are stirred and mixed by the stirring roller 15 and stick on the charging sleeve 12 to form magnetic brush 11A. The magnetic brush 11A is conveyed together with the charging sleeve 12 and comes in contact with the photoreceptor drum 30 to form the nip portion.

On the charging sleeve 12, there is impressed A.C. bias voltage from the power source 20, and an oscillating electric field is formed between the charging sleeve 12 and the photoreceptor drum 30. When the magnetic brush 11A and the photoreceptor drum 30 are brought into contact with each other under the oscillating electric field, injection of electric charges and discharge are carried out from the charging sleeve 12 to the photoreceptor drum 30, thereby the photoreceptor drum 30 is charged with electricity.

Next, an image forming apparatus employing an electrical charging device of the invention will be explained as follows.

Figure 2:
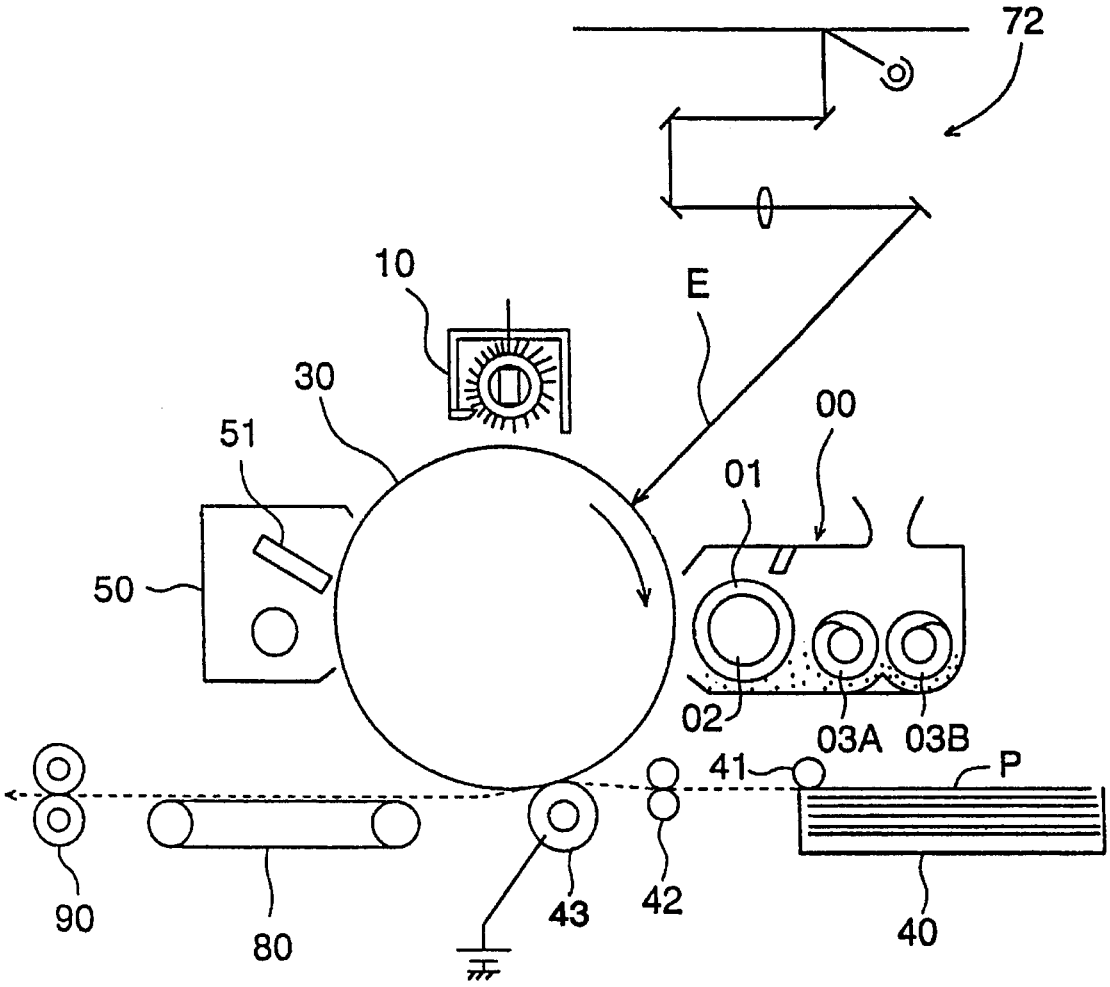
FIG. 2 is a sectional view showing an example of an image forming apparatus to which the invention is applied.

FIG. 2 represents a sectional view showing an example of an image forming apparatus of a type of Carlson process wherein an electrical charging device shown in FIG. 1 is incorporated.

The numeral 30 represents a photoreceptor drum that is an image forming object rotating in the arrowed direction at a speed of 10–50 cm/sec. The photoreceptor drum 30 is a negative charging organic photoreceptor wherein a subbing layer of polyvinyl alcohol, polyvinyl butyral, ethylcellulose, carboxymethylcellulose, polyamide and casein, for example, a charge-generating layer (CGL) containing charge-generating material (CGM) such as azo pigment, polycyclic quinone pigment, perylene pigment and phthalocyanine pigment, and a charge-transport layer (CTL) containing charge-transport material (CTM) such as aromatic amine compounds, hydrazone compounds, pyrazoline compounds and triarylamine compounds are laminated in this order on a conductive base.

The numeral 00 represents a developing unit having therein fixed magnetic object 02, a developing roller composed of sleeve 01 that rotates around the fixed magnetic object 02 in the regular direction at the speed higher than that of photoreceptor drum 30, and stirring members 03A and 03B, and the developing unit 00 houses mono-component developers composed of magnetic toner, for example, or two-component developers composed of non-magnetic toner and magnetic carrier.

The numeral 10 is an electrical charging device shown in FIG. 1, and A.C. bias wherein D.C. component with absolute value of 500–1000 (V) is superimposed on A.C. component having D.C. current $I_{AC}$ of 0.1–10 (mA) and frequency of 100–5000 (Hz) is impressed on the electrical charging device 10 from an unillustrated bias impressing means, thus photoreceptor drum 30 is charged uniformly.

Then, an electrostatic latent image is formed on the photoreceptor drum 30 by imagewise exposure E from exposure system 72, and the electrostatic latent image is developed by the developing unit 00, thus, a toner image is formed.

This toner image is transferred, by a transfer means such as transfer roller 43 impressed with voltage, onto transfer sheet P that is fed from paper feed cassette 40 by paper feed roller 41 and timing roller 42. The transfer sheet P carrying the toner image is conveyed by conveyance means 80 to fixing unit 90 where the toner image is fixed. The photoreceptor drum 30 after transferring is cleaned by a cleaning means such as blade 51 of cleaning unit 50 or a fur brush.

Next, the conditions related to the invention will be explained as follows.

First, the condition for magnetic particles will be explained.

In the invention, it is possible to use magnetic particles of ferromagnetic substance such as iron, ferrite and magnetite which are the same as magnetic particles which have hitherto been used as a magnetic carrier for two-component developer, or magnetic particles each being covered with an insulating or conductive layer, or magnetic particles obtained by crushing and classifying the mixture including fine powder of magnetic substances and resins.

It is preferable that a volume average particle size of the above-mentioned magnetic particles is 50–150 μm, and the range of 70–120 μm is especially preferable. When the volume average particle size is lower than 50 μm, the magnetic particles tend to stick to an image forming object to flow out, while when it exceeds 150 μm, bristles of a magnetic brush tend to be coarse, causing uneven charging.

The aforementioned volume average particle size of magnetic particles is a volume-based average particle size obtained by measuring with a laser diffraction type particle size distribution measuring instrument equipped with a wet homogenizer "HELOS" (made by SYMPATEC Co.), and it is a value obtained through measurement after the pretreatment wherein magnetic particles in quantity of several tens mg are dispersed together with surfactant in 50 ml of water by the wet homogenizer, and then are dispersed by a supersonic homogenizer (output of power: 150 W) for 1–10 minutes while attention is paid to prevent re-aggregation caused by heat heneration.

It is preferable that saturation magnetization of the above-mentioned magnetic particles is 40–100 emu/g and the range of 60–90 emu/g is especially preferable. When the saturation magnetization is lower than 40 emu/g, the magnetic particles tend to stick to an image forming object to flow out, while when it exceeds 100 emu/g, bristles of a magnetic brush tend to be coarse, causing uneven charging in the sweeping pattern.

The aforementioned saturation magnetization of magnetic particles can be obtained through the method wherein the magnetic particles are tapped into a sample cell having a volume of 0.25 $cm^2 \times 3$ cm, then the sample is affixed to a pickup coil to be set on a magnetizer, and a D.C. magnetization characteristic automatic recording instrument "Type 3257" (made by Yokogawa Hokushin Denki Co.) is used so that a hysteresis curve may be drawn by an X-Y recorder.

It is preferable that an apparent specific resistance of the above-mentioned magnetic particles is $10^6$–$10^{10}$ Ω·cm, and the range of $10^8$–$10^9$ Ω·cm is especially preferable. When the apparent specific resistance is lower than $10^6$ Ω·cm, charging failure called a banding trouble tends to occur when a pin hole or a scratch exists on an image forming object, while when it exceeds $10^{10}$ Ω·cm, the magnetic particles tend to stick to an image forming object to flow out and charging failure also tends to occur.

The aforementioned apparent specific resistance of magnetic particles can be obtained through a method wherein the magnetic particles are tapped into a container having a cross-sectional area of 1.0 $cm^2$, then a load of 500 $g/cm^2$ is applied on the filled magnetic particles, and voltage generating an electric field of 1000 V/cm between the load and a bottom electrode is impressed to read the current value.

It is preferable that the shape of the aforementioned magnetic particle is spherical without having any protrusions such as an acicular portion or an edge portion. When there are acicular or edge portions, an electric field tends to be concentrated at these portions and uneven charging is apt to occur.

Incidentally, the apparent density ρ of the aforementioned magnetic particles is about 1–4 $g/cm^3$ generally.

In this case, the apparent density ρ ($g/cm^3$) of the magnetic particles was calculated by measuring the weight of magnetic particles tapped into a cylindrical 100 cc (=100 $cm^3$) glass container.

Figure 3:
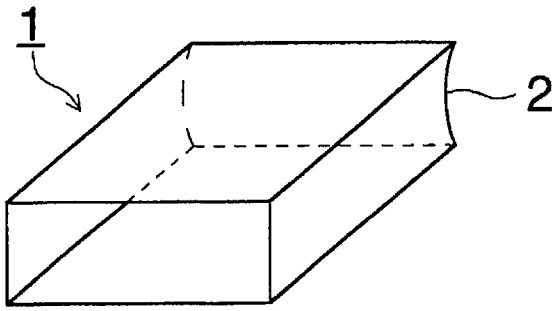
FIG. 3 is an illustration explaining how to measure an amount of magnetic particles existing on the conveying carrier.
Figure 3:
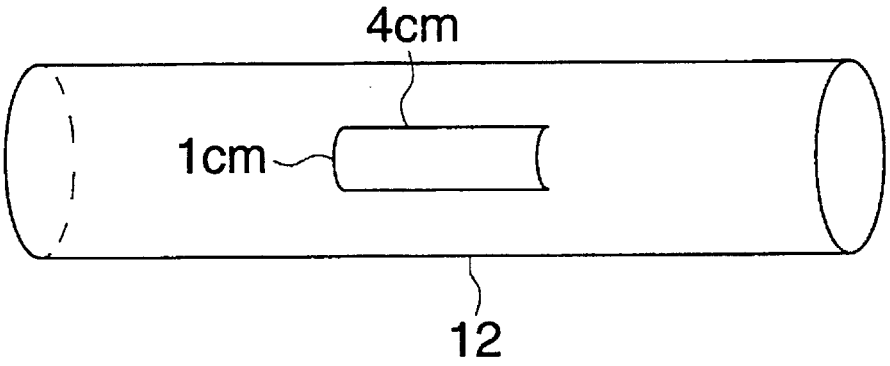

Amount M ($g/cm^2$) of magnetic particles existing at the nip portion on a conveying carrier was calculated through a method wherein an electrical charging device is removed from an image forming apparatus after image forming (charging), then member 1 made of 1 cm×4 cm aluminum having a shape shown in FIG. 3 is pressed on a layer of magnetic particles on the conveying carrier to form a pattern of 4 $cm^2$, then magnetic particles surrounding the pattern of 4 $cm^2$ are removed by a fragment such as a cleaning blade, and the remaining magnetic particles corresponding to 4 $cm^2$ on the conveying carrier are collectedly a magnet and their weight is measured.

Further, with regard to nip width L (cm) and distance D (cm) between the end of the nip and a magnet, an electrical charging device was removed from an image forming apparatus after image forming (charging), then the nip area and a central position of a magnetic pole were found, and thereby the length was measured.

Next, in the invention, when assuming that ρ ($g/cm^3$) represents the apparent density of magnetic particles 11 forming the aforementioned magnetic brush 11A, M ($g/cm^2$) represents an amount of the magnetic particles 11 existing on charging sleeve 12 including the nip area, and H (cm) represents the minimum clearance between the charging sleeve 12 and photoreceptor drum 30 in the nip area, the amount M of magnetic particles 11 existing on the charging sleeve 12 and the minimum clearance H between the charging sleeve 12 and the photoreceptor drum 30 are set so that the relation of $$\rho \leqq M/H \leqq 1.6\,\rho$$

may be satisfied, or the relation of $$1.2\,\rho \leqq M/H \leqq 1.4\,\rho$$

may preferably be satisfied.

The amount M of magnetic particles 11 existing on charging sleeve 12 is established in accordance with a clearance between the charging sleeve 12 and the regulating plate 14, an arrangement of the center of a magnetic pole of fixed magnetic object 13 provided inside the charging sleeve 12, and the surface roughness of the charging sleeve 12, while the minimum clearance H between the charging sleeve 12 and the photoreceptor drum 30 is established, for example, by providing rollers each having a radius that is larger than the radius of the charging sleeve 12 by the minimum clearance H on both ends of the cylindrical charging sleeve 12 so that the rollers may be brought into contact with the photoreceptor drum 30.

When M/H is within the aforementioned range, bristles of magnetic brush 11A are compressed by the clearance between the charging sleeve 12 and the photoreceptor drum 30, and the bristles are compressed to the utmost to be in mostly densely filled state in the nip area. In a practical manner, the value ($g/cm^3$) obtained by dividing the existence amount ($g/cm^2$) of magnetic particles per unit area with the height (cm) of the magnetic particles layer can not exceed the value of the apparent density ρ ($g/cm^3$) of the magnetic particles. Practically, however, the packing state close to the mostly densely filled state is realized when the value of M/H exceeds the value of ρ because the charging sleeve 12 is not in parallel with the photoreceptor drum 30. In this case, the magnetic brush 11A comes in contact with the photoreceptor drum 30 uniformly, and thereby uniform charging that is free from uneven charging and sticking of magnetic particles can be obtained.

When M/H is lower than the above-mentioned range, magnetic brush 11A is compressed insufficiently in the nip area and thereby only the tip portion of bristles of the magnetic brush 11A is brought into contact with the photoreceptor drum 30. Therefore, uneven charging in the pattern of streaks or ring marks is caused and magnetic particles 11 also stick to the photoreceptor drum 30.

When M/H exceeds the range mentioned above, the conveyance of the magnetic brush 11A caused by the rotation of the charging sleeve becomes unstable or the conveyance is not carried out. Accordingly, there are formed an area where the charging is insufficient and an area where the charging is uniform in the direction of the movement of the photoreceptor drum 30, thus adherence of magnetic particles 11 to the photoreceptor drum 30 takes place. In addition, the surface of the photoreceptor drum 30 is scratched by the magnetic particles 11, resulting in the problem of change in charging characteristics.

Further, in the invention, when assuming that L (cm) represents a nip width and D (cm) represents a distance between an ending point of the nip and the position on the charging sleeve corresponding to the center of a magnetic pole of a magnetic object that is at the downstream side of the ending point of the nip and is closest thereto, the center of the magnetic pole of the fixed magnetic object is arranged so that the relation of $$L/2 \leqq D$$

may be satisfied, in addition to setting the moving direction of the charging sleeve 12 in the nip area to be the same as that of the photoreceptor drum 30.

Namely, the magnetic brush 11A compressed to be uniform in the nip area can be conveyed without being disturbed on its bristles because the moving direction of the charging sleeve 12 is the same as that of the photoreceptor drum 30, and the bristles of the magnetic brush 11A conveyed while keeping their uniform state can keep their uniform state because the magnetic poles are arranged so that the bristles of the magnetic brush 11A may not be disturbed in the area where the magnetic brush 11A located at the downstream side of the ending point of the nip leaves the photoreceptor drum 30. Thereby, uniform charging that is free from uneven charging and sticking of magnetic particles can be obtained.

On the other hand, when the moving direction of the charging sleeve 12 in the nip area is made to be opposite to that of the photoreceptor drum 30, uneven charging in the pattern of streaks or ring marks is caused and sticking of magnetic particles 11 to the photoreceptor drum 30 also takes place because the bristles of the magnetic brush 11A in the area where the magnetic brush 11A leaves the photoreceptor drum 30 are in the uneven state which is before the compression in the nip area.

When D is smaller than L/2, uneven charging in the pattern of streaks or ring marks is caused and sticking of magnetic particles 11 to the photoreceptor drum 30 also takes place because the state of the bristles of the magnetic brush 11A in the area where magnetic brush 11A leaves the photoreceptor drum 30 due to the magnetic pole at the downstream side of the ending point of the nip is disturbed.

Next, charging sleeve 12 that is a conveying carrier will be explained.

Charging sleeve 12 is a cylinder made of non-magnetic and conductive metal such as aluminum or stainless steel.

It is preferable that a diameter of the charging sleeve 12 is 1/10–1/3 times that of photoreceptor drum 30. When a diameter of the photoreceptor drum 30 is not more than 3 cm, it is especially preferable that the diameter of the charging sleeve 12 is ¼–⅓ times that of the photoreceptor drum 30, and when a diameter of the photoreceptor drum 30 exceeds 3 cm, it is especially preferable that the diameter of the charging sleeve 12 is 1/10–¼ times that of the photoreceptor drum 30, With the aforementioned range in terms of diameter, a nip area necessary for charging can be secured and nip width L takes values of 0.2–1 cm. When the nip width L is large unnecessarily, charging failure called a banding trouble tends to occur when a pin hole or a scratch exists on an image forming object, while when it is small unnecessarily, uneven charging called a cycle spot tends to occur.

The surface roughness of the charging sleeve 12 taking the value that is 1/40–¼ of a volume average particle size of the magnetic particles is preferable and that taking the value that is 1/10–⅓ of a volume average particle size of the magnetic particles is especially preferable. When the surface is smooth unnecessarily, conveyance of magnetic brush 11A tends to be unstable, while when it is rough unnecessarily, overcurrent tends to flow from the protrusion on the surface, and uneven charging tends to occur in either case. For keeping the surface roughness of the charging sleeve 12 to be within the aforementioned range, sand-blasting treatment or thermal spraying treatment is preferably employed.

Minimum clearance H between the charging sleeve 12 and photoreceptor drum 30 is established based on the relation between existence amount M of magnetic particles 11 on charging sleeve 12 including the nip area and apparent density ρ of the magnetic particles 11. It is preferable that the minimum clearance is 4–15 times the volume average particle size of the magnetic particles, it is especially preferable that the minimum clearance is 10–12 times the volume average particle size when the volume average particle size is not more than 80 μm, while when the volume average particle size exceeds 80 μm, the minimum clearance that is 8–10 times the volume average particle size is especially preferable. With the range of the minimum clearance mentioned above, a nip area necessary for charging can be secured and conveyance of magnetic brush 11A can be carried out stably.

The minimum clearance $D_R$ between the charging sleeve 12 and the regulating plate 14 is established for the purpose of keeping the existence amount M of magnetic particles 11 on charging sleeve 12 to be within a predetermined range. It is preferable that the minimum clearance $D_R$ is 0.8–1.6 times the minimum clearance H between the charging sleeve 12 and photoreceptor drum 30, and it is especially preferable that the minimum clearance $D_R$ is 1–1.4 times the minimum clearance H. With the ranges mentioned above, magnetic brush 11A can be compressed sufficiently in the nip area.

Incidentally, the existence amount M of magnetic particles 11 on charging sleeve 12 including the nip area is about 0.1–0.5 g/cm$^2$ generally.

It is preferable that moving speed (circumferential speed) of the charging sleeve 12 is 1-1/20 times that (circumferential speed) of the photoreceptor drum 30, and when the moving speed of the photoreceptor drum 30 is not higher than 10 cm/sec, it is preferable that the speed is 1-½ times that of the drum 30, and further when the moving speed of the photoreceptor drum 30 exceeds 100 cm/sec, the moving speed of the charging sleeve that is ½-1/10 times that of the photoreceptor drum 30 is especially preferable. When the moving speed of the charging sleeve 12 is high unnecessarily, magnetic particles 11 tend to scatter due to centrifugal force or tend to stick to photoreceptor drum 30, while when it is low unnecessarily, disturbance of bristles of magnetic brush 11A formed on the charging sleeve 12 is insufficient and uneven charging in the sweeping pattern tends to occur.

For magnetic object 13, any magnetic object can be used provided that it is magnetized so that the magnetic field on the surface of the charging sleeve 12 is 500–1200 gauss, and preferably is 700–1000 gauss. It is generally a cylindrical magnetic object having therein a plurality of magnetic poles each being magnetized to be N-pole or S-pole, and a magnetic object with unsymmetrical 5 poles or one with symmetrical or unsymmetrical 6 poles is used preferably.

It is preferable that the center of the magnetic pole that is closest to the photoreceptor drum 30 among plural magnetic poles in the magnetic object 13 is within the nip area, and it is especially preferable that the center is located between the position in the nip area where the charging sleeve 12 and the photoreceptor drum 30 are closest to each other and the nip-ending point. When the center of the magnetic pole is located at the position mentioned above, magnetic brush 11A compressed in the nip area to be uniform can be conveyed while keeping its uniform state even at the downstream side of the nip-ending point, thereby magnetic particles 11 neither scatter nor stick to photoreceptor drum 30.

When assuming that θ1(°) represents an angle formed by a straight line passing through the center of the magnetic pole positioned at the upstream side of the regulating plate 14 and the center of the magnetic object 13 and by a straight line passing through the regulating plate 14 and the center of the magnetic object 13, θ2 represents an angle formed by a straight line passing through the regulating plate 14 and the center of the magnetic object 13 and a straight line passing through the center of the magnetic pole positioned at the downstream side of the regulating plate 14 and the center of the magnetic object 13, B 1 (gauss) represents a magnetic field at the surface of charging sleeve 12 facing the center of the magnetic pole positioned at the upstream side, and B 2 (gauss) represents a magnetic field at the surface of charging sleeve 12 facing the center of the magnetic pole positioned at the downstream side, it is preferable that the following relation is satisfied for centers of the magnetic poles of the magnetic object 13 located at the downstream side and upstream side of the regulating plate 14 among plural magnetic poles in the magnetic object 13.

$$B\ 1/B\ 2\times 0.8 \leqq \theta 1/\theta 2 \leqq B\ 1/B\ 2\times 1.2$$

It is especially preferable that the following relation is satisfied.

$$B\ 1/B\ 2\times 0.9 \leqq \theta 1/\theta 2 \leqq B\ 1/B\ 2\times 1.1$$

In the relation mentioned above, magnetic brush 11A can be conveyed stably and existence amount M of magnetic particles 11 on charging sleeve 12 including a nip area is stabilized.

Incidentally, there sometimes occurs a problem that bristles of magnetic brush 11A which has passed through the regulating plate 14 rises suddenly on the magnetic pole located at the downstream side of the regulating plate 14 and magnetic particles scatter, although this phenomenon depends on a magnetic field on the surface of charging sleeve 12 facing the magnetic pole at the downstream side of the regulating plate 14, a distance between the magnetic pole and the regulating plate 14 and saturated magnetization of the magnetic particles. In this case, it is preferable to provide a leveling plate or a shielding plate in a manner that it touches or does not touch the magnetic brush 11A to cover it.

Now, α setting condition of A.C. bias is explained.

The aforementioned A.C. bias is A.C. bias voltage wherein A.C. component is superimposed on D.C. component, and it is impressed on charging sleeve 12 from power source 20, thus, an oscillating electric field is generated between the charging sleeve 12 and photoreceptor drum 30.

It is preferable that D.C. component in the A.C. bias is the same in value as the aimed charged voltage of the photoreceptor drum 30, and it is normally within the range of 500–1000 (V) in absolute value. The D.C. component is preferably subjected to constant-voltage control.

When assuming that $I_{AC}$ represents an electric current of the A.C. component (hereinafter referred to as A.C. current) and $(I_{AC})_{th}$ represents a threshold value of the A.C. current for the charging voltage which will be explained later, the relation of $(I_{AC})_{th} \leqq I_{AC} \leqq 1.5 \times (I_{AC})_{th}$ is preferable for the A.C. component in A.C. bias, and the relation of $(I_{AC})_{th} \leqq I_{AC} \leqq 1.2 \times (I_{AC})_{th}$ is especially preferable. Normally, $I_{AC}$ is 0.1–10 (mA). If $I_{AC}$ is lower than the above-mentioned range, streak-shaped uneven charging tends to occur, while if it is higher than that range, ring-mark-shaped uneven charging occurs and ozone tends to be generated. The A.C. component is preferably subjected to constant-voltage control.

The threshold value $(I_{AC})_{th}$ for the aforesaid charging voltage is obtained when A.C. current $I_{AC}$ is changed while D.C. component is kept constant both in the aforesaid A.C. bias and the then charging voltage on the photoreceptor drum 30 is measured. Namely, when the A.C. current $I_{AC}$ is increased, the absolute value of the charging voltage grows greater, and when the A.C. current $I_{AC}$ exceeds the threshold value, the absolute value of the charging voltage is saturated to become the value that is mostly the same as the absolute value of the D.C. component. The threshold value at this time is threshold value $(I_{AC})_{th}$ of A.C. current for the charging voltage.

With regard to frequency of A.C. component in the A.C. bias, when assuming that f ($H_z$) represents that frequency, V (cm/sec) represents the moving speed (peripheral speed) of the photoreceptor drum 30 that is an image forming object, and L (cm) represents the nip width, the relation of $V/L \times 10 \leqq f$ is preferable and the relation of $V/L \times 20 \leqq f \leqq V/L \times 50$ is especially preferable. When the frequency f is lower than that range, uneven charging called cycle spot tends to occur, while if it is higher than is needed, the current value of the A.C. component is increased and ozone tends to be generated.

Incidentally, a waveform of the A.C. component in the A.C. bias may also be a rectangular wave or a triangular wave without being limited to a sine wave.

EXAMPLE

Examples of the invention will be explained concretely as follows.

(Example 1)

[Conditions of an electrical charging device]

Apparent density of magnetic particles: 2.8 g/cm$^3$

Existence amount M of magnetic particles on the charging sleeve including a nip area: 0.25 g/cm$^2$ Minimum clearance H between the charging sleeve and the photoreceptor drum: 0.07 cm Moving direction of the charging sleeve: Same direction as of the photoreceptor drum at a nip area Nip width L: 0.6 cm Distance D between a nip end and the magnetic pole at downstream side of the nip end: 1.1 cm

[Other conditions]

Volume average particle size of magnetic particles: 108 μm

Saturated magnetization of magnetic particles: 63 emu/g

Apparent specific resistance: $3 \times 10^8$ Ω·cm

Shape of a magnetic particle: Spherical

Material of magnetic particles: Cu-Zn-ferrite of $(CuO)_{0.235}(ZnO)_{0.235}(Fe_2O_3)_{0.53}$ Diameter of the charging sleeve: 1.8 cm Surface roughness of the charging sleeve: 20 μm Material of the charging sleeve: Stainless steel Moving speed (peripheral speed) of the charging sleeve: 10 cm/sec Minimum clearance $D_R$ between the charging sleeve and the regulating plate: 0.09 cm Number of magnetic poles of the magnetic object: 5 poles (called N1 pole, S1 pole N2 pole, N3 pole and S2 pole in that order starting from the magnetic pole closest to the photoreceptor drum in the downstream direction of charging sleeve movement)

Angle formed by magnetic poles on the magnetic object: Angle between N1 pole and S1 pole=80°, angle between S1 pole and N2 pole=50°, angle between N2 pole and N3 pole=110°, angle between N3 pole and S2 pole=60° and angle between S2 pole and N1 pole=60°

Magnetic field on the surface of the charging sleeve: N1 pole=900 gauss, S1 pole=750 gauss, N2 pole=550 gauss, N3 pole=500 gauss and S2 pole=700 gauss Position of N1 pole: 10° toward downstream side from the point where the charging sleeve is closest to the photoreceptor drum Position of the regulating plate: Angle between N3 pole and the regulating plate=25°, angle between S2 pole and the regulating plate=35°

Structure of the photoreceptor drum: Photoreceptor drum wherein a 0.1-μm-thick subbing layer prepared with polyamide, a 0.1-μm-thick charge-generating layer whose principal ingredients are azo type pigment and polycarbonate resin, and a 25-μm-thick charge-transport layer whose principal ingredients are styryltriphenylamine derivatives and polycarbonate resins are formed in succession on a cylindrical aluminum base having a diameter of 8 cm, a length of 35 cm and a thickness of 0.1 cm Moving speed (peripheral speed) of the photoreceptor drum: 23 cm/sec D.C. component of A.C. bias: −800 V (constant voltage control)

A.C. component of A.C. bias: 2.1 mA (constant voltage control), frequency 2000 Hz, sine wave

[Image forming test]

Under the above-mentioned conditions and the environmental conditions including normal temperature and normal humidity of 20° and 50% RH, high temperature and high humidity of 30° and 80% RH and low temperature and low humidity of 10° and 20% RH, image forming tests were made with the modified Konica U-BIX 3035 (made by Konica Corp.) equipped with an electrical charging device of the invention. Under any environmental conditions, clear images free from uneven charging were obtained, proving that uniform charging without uneven charging has been obtained.

Further, bristles of the magnetic brush were checked after removing the electrical charging device. It was observed that the bristles of the magnetic brush at the nip area were compressed and the bristles located at the downstream side of a nip end were leveled. (See FIG. 1)

In addition to the above, tests of continuous copying for 10,000 copies were made under the condition of normal temperature and normal humidity of 20° and 50% RH. During the tests, clear images free from image unevenness were obtained stably, and even after the continuous copying of 10,000 copies, reduction of magnetic particles in the electrical charging device was not observed at all, and uneven charging and sticking of magnetic particles to the photoreceptor drum were not observed, proving that uniform charging has been obtained.

Figure 4:
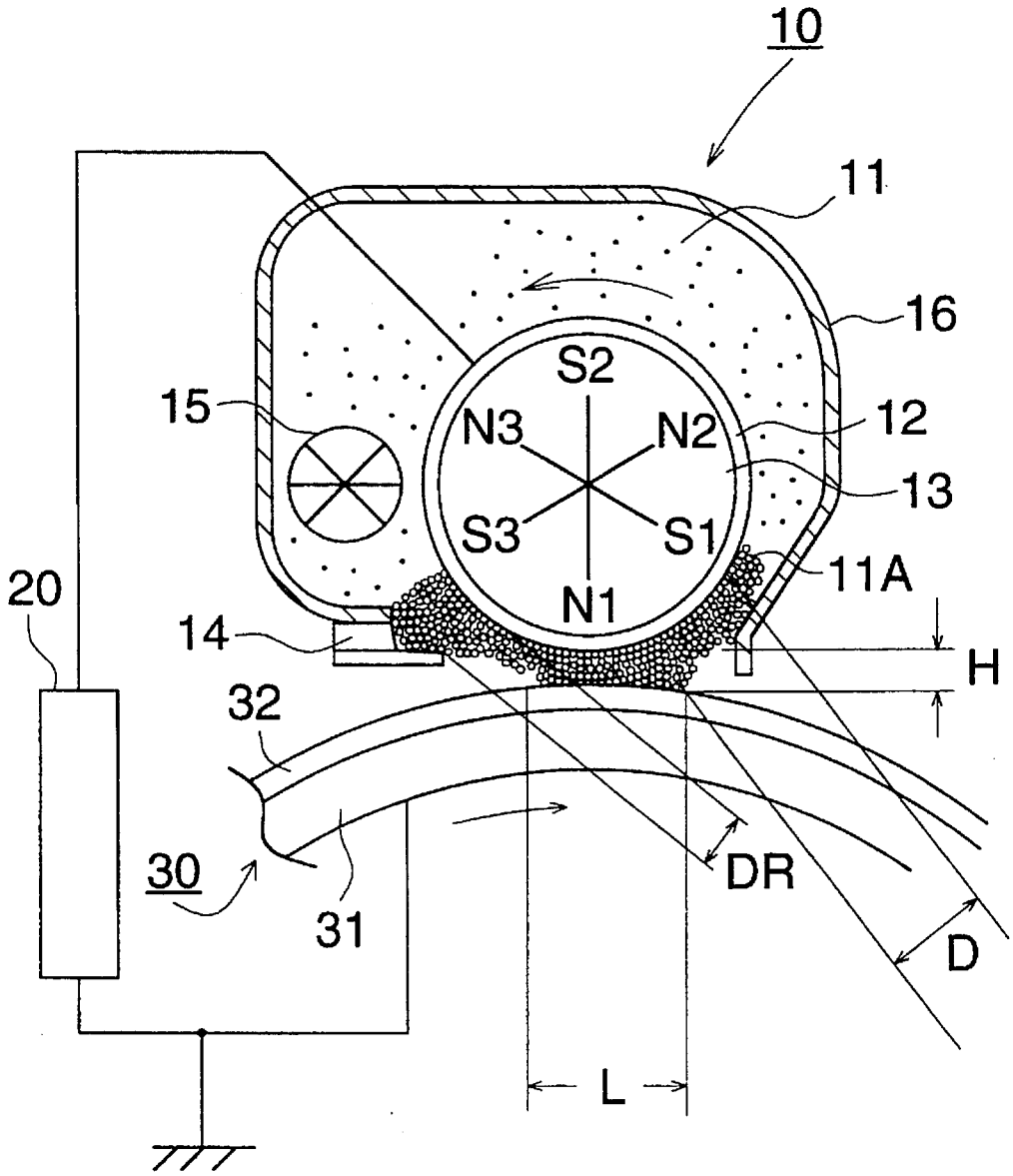
FIG. 4 is a sectional view showing the other example of the electrical charging device of the invention.

Under the conditions mentioned above, image forming tests were made in the same manner as in Example 1. In the tests, clear images free from uneven charging were obtained stably as in Example 1, and reduction of magnetic particles in the electrical charging device was not observed at all, and uneven charging and sticking of magnetic particles to the photoreceptor drum were not observed, proving that uniform charging has been obtained. In this case, the state of bristles of the magnetic brush was uniform as in Example 1. (See FIG. 4.)

(Comparative example 1)

[Electrical charging device conditions and other conditions]

All conditions except the following conditions are the same as those in Example 1.

Minimum clearance H between the charging sleeve and the photoreceptor drum: 0.08 cm Nip width L: 0.6 cm Distance D between a nip end and the magnetic pole at downstream side of the nip end: 0.95 cm

[Image forming tests]

Figure 5:
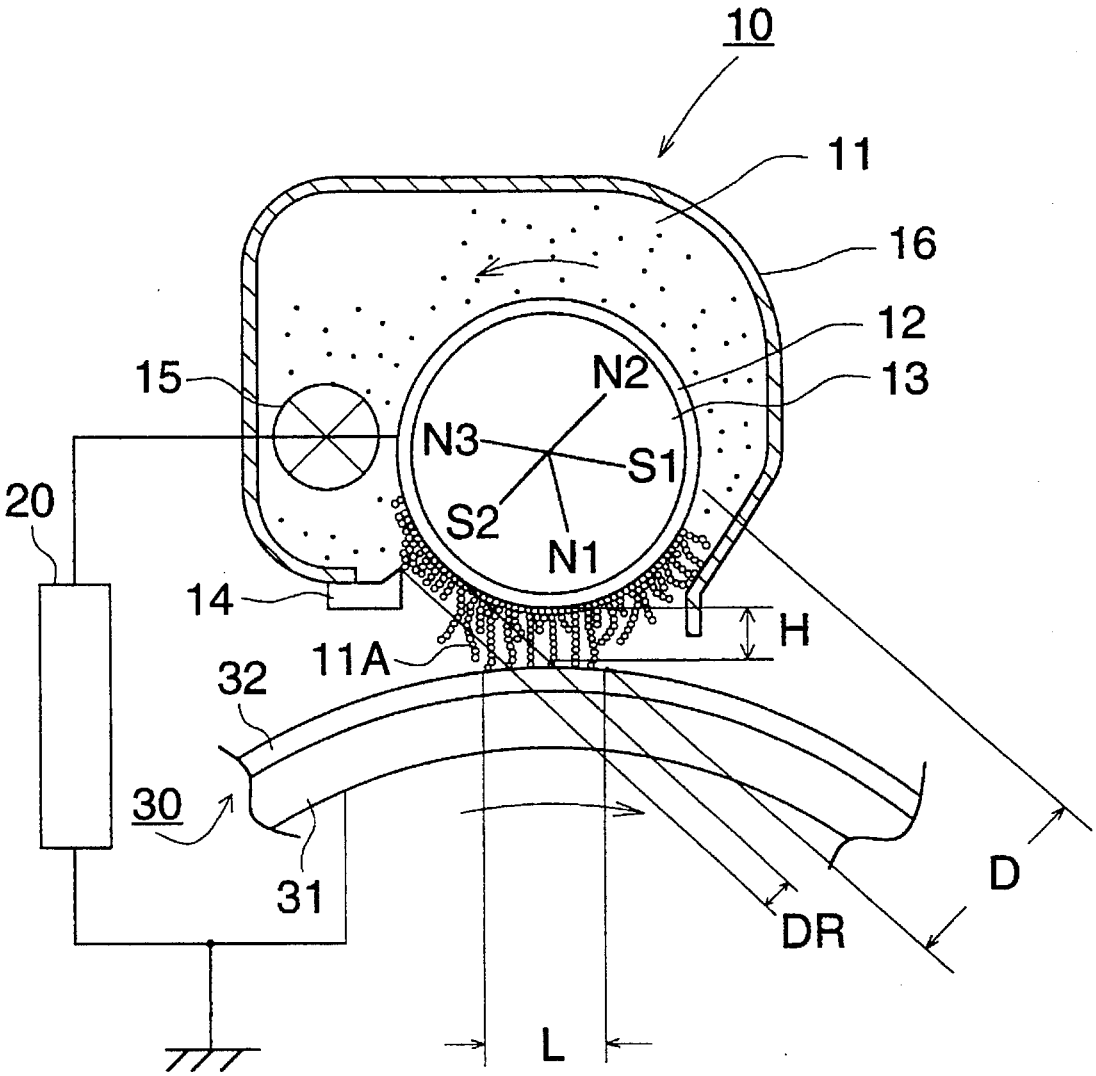
FIG. 5 is a sectional view showing an example of an electrical charging device other than that of the invention.

Under the above-mentioned conditions and the environmental condition of normal temperature and normal humidity of 20° and 50% RH, image forming tests were made in the same manner as in Example 1, and streak-shaped image unevenness was observed on the halftone area, showing an occurrence of uneven charging. Further, the state of bristles of the magnetic brush was checked after removing the electric charging device. The results of checking showed that the magnetic brush was not compressed at the nip area and the brush was in the uneven state both at the nip area and in the downstream side of the nip end. After that, continuous copying for 2000 copies was made under the same environmental conditions, and it was found that magnetic particles in the electrical charging device was reduced from 70 g to 67 g during continuous copying and magnetic particles stuck to the photoreceptor drum. (See FIG. 5.)

(Comparative example 2)

[Electrical charging device conditions and other conditions]

All conditions except the following conditions are the same as those in Example 1.

Distance D between a nip end and a magnetic pole at downstream side of the nip end: 0.25 cm Position of N1 pole: 25° toward upstream side from the point where a charging sleeve is closest to a photoreceptor drum

[Image forming tests]

Under the above-mentioned conditions and the environmental condition of normal temperature and normal humidity of 20° and 50% RH, image forming tests were made in the same manner as in Example 1, and ring-mark-shaped image unevenness was observed on the halftone area, showing an occurrence of uneven charging. Further, the state of bristles of the magnetic brush was checked after removing the electric charging device. The results of checking showed that the magnetic brush was compressed at the nip area but the bristles were lifted and disturbed in the downstream side of the nip end.

Figure 6:
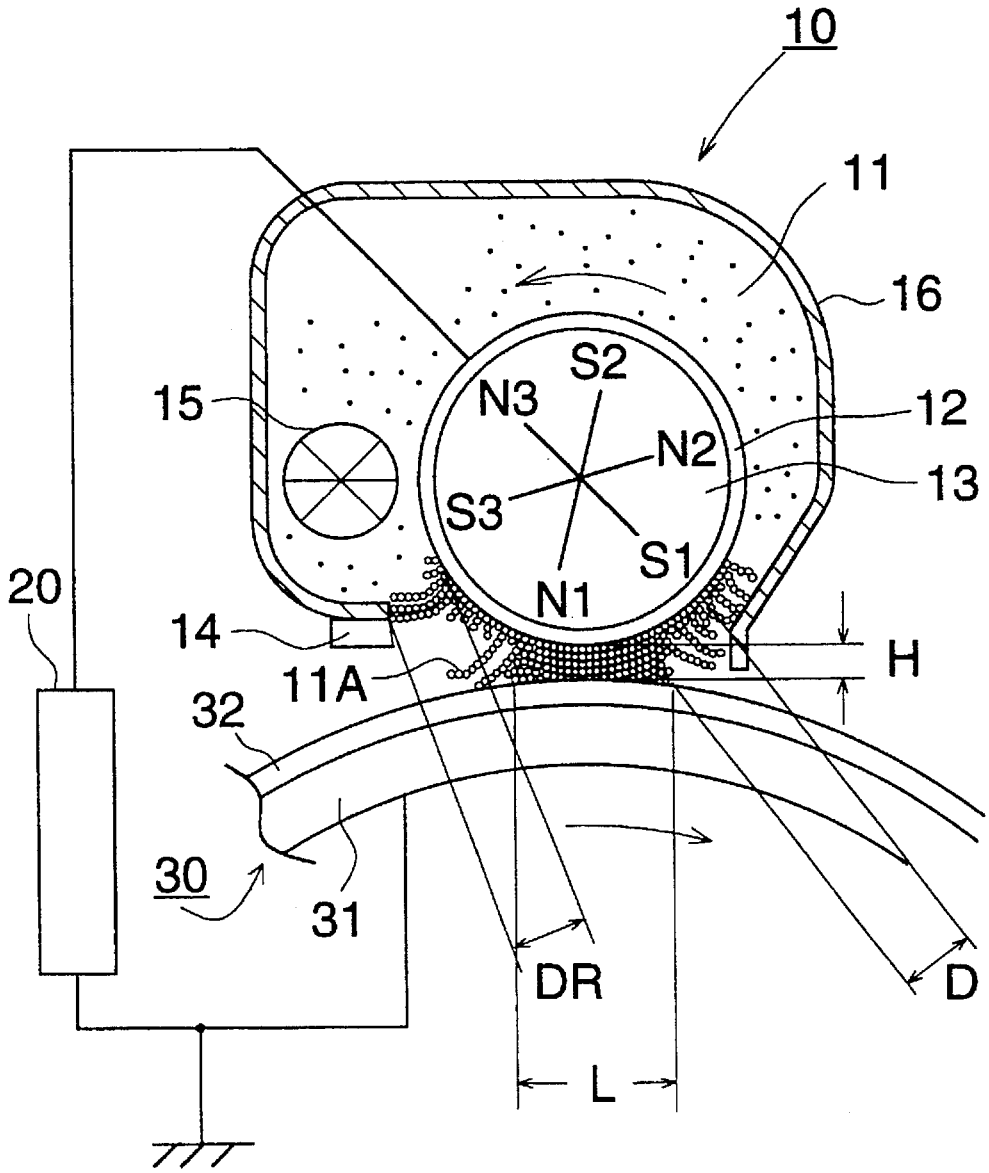
FIG. 6 is a sectional view showing the other example of an electrical charging device other than that of the invention.

After that, continuous copying for 2000 copies was made under the same environmental conditions, and it was found that magnetic particles in the electrical charging device was reduced from 70 g to 61 g during continuous copying and magnetic particles stuck to the photoreceptor drum and scattered. (See FIG. 6.)

(Comparative example 3)

[Electrical charging device conditions and other conditions]

All conditions except the following conditions are the same as those in Example 1.

Existence amount M of magnetic particles on the charging sleeve including a nip area: 0.24 g/cm$^2$ Moving direction of the charging sleeve: Direction opposite to that of the photoreceptor drum at a nip area Nip width L: 0.6 cm Distance D between a nip end *1 and a magnetic pole *2 at downstream side of the nip end: 0.8 cm

*1) Nip end position at downstream side in the moving direction of the photoreceptor drum (Nip end position at upstream side in the moving direction of the charging sleeve)

*2) Magnetic pole located at the aforementioned nip end at downstream side in the moving direction of the photoreceptor drum (at the upstream side in the moving direction of the charging sleeve) (→S1)

Position of N1 pole: 10° toward upstream side (downstream side in the moving direction of the charging sleeve) in the moving direction of a photoreceptor drum from the point where a charging sleeve is closest to the photoreceptor drum Position of the regulating plate: The position of the regulating plate was changed to the position between S1 pole and N2 pole.

Angle between S1 pole and the regulating plate=25°

Angle between N2 pole and the regulating plate=25°

[Image forming tests]

Figure 7:
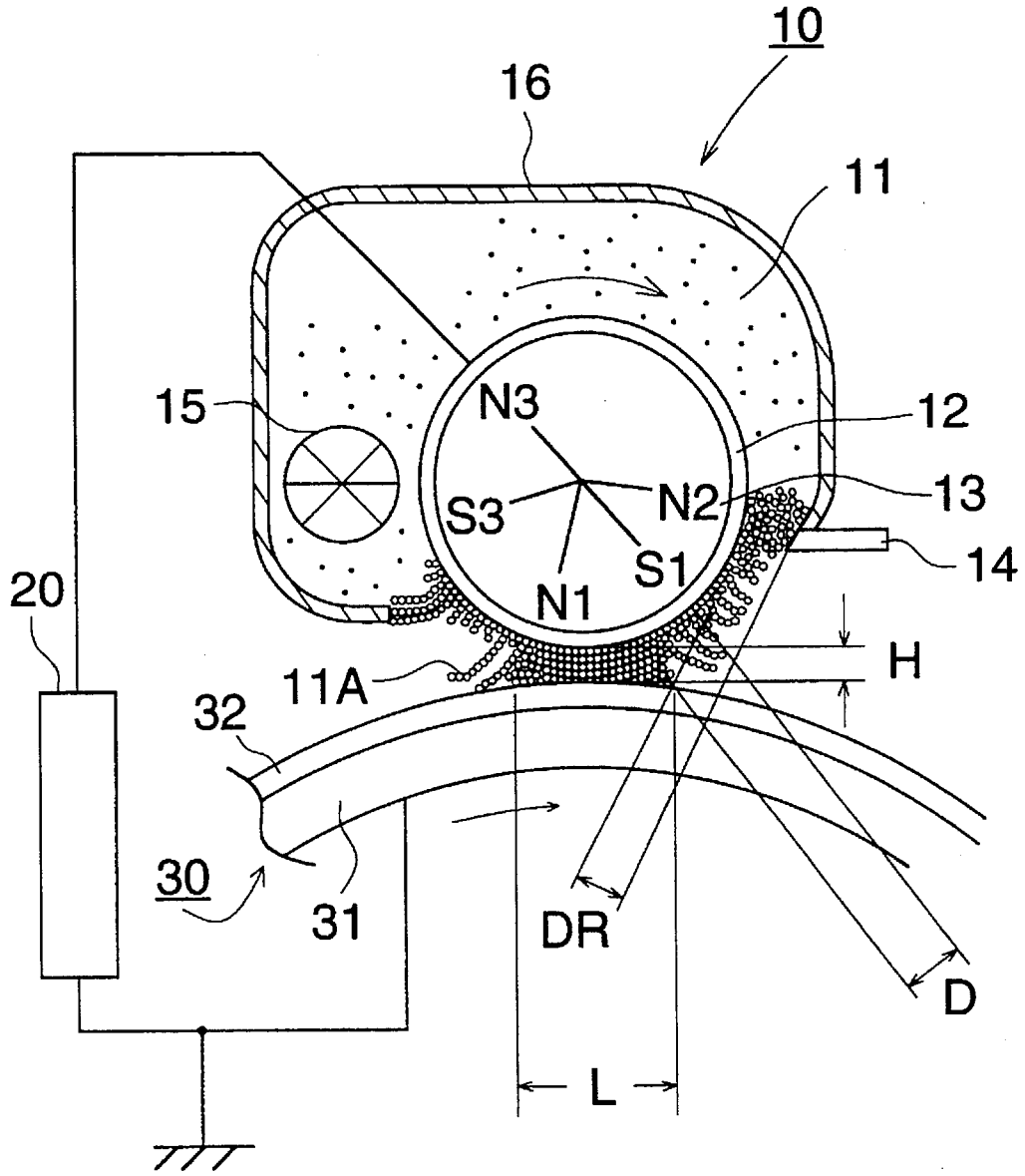
FIG. 7 is a sectional view showing another example of an electrical charging device other than that of the invention.

Under the above-mentioned conditions and the environmental condition of normal temperature and normal humidity of 20° and 50% RH, image forming tests were made in the same manner as in Example 1, and black spots were observed on the entire image and considerable amount of magnetic particles sticking to the photoreceptor drum were observed. Reduction of weight of magnetic particles was measured after removing the electrical charging device, in which the reduction from 70 g to 65 g during only 10 copies was found. (See FIG. 7.)

Due to the structure of the electrical charging device of the invention wherein a magnetic brush is compressed at a nip area and is conveyed in the direction identical to the moving direction of the image forming object and yet the magnetic brush does not rise in the area where the magnetic brush at downstream side of a nip end leaves the image forming object, contact between the magnetic brush and the image forming object in the nip portion can be uniform, bristles of the magnetic brush at downstream side of the nip end can be kept in the uniform state, and streak-shaped or ring-mark-shaped uneven charging and sticking of magnetic particles to the image forming object are not caused, thus uniform charging can be obtained.

What is claimed is:

1. An apparatus for charging an image surface of an image carrying member which is rotated in a predetermined direction, comprising:

a rotatable cylinder arranged to face the image carrying member so as to form a minimum gap section at which a gap distance between the cylinder and the image carrying member becomes minimum, wherein a minimum gap distance at the minimum gap section is H (cm) and the cylinder is rotated in the same direction as that of the image carrying member at the minimum gap section;

a magnet member having plural magnetic poles being fixed in the cylinder;

a magnetic brush formed by magnetic particles on a surface of the cylinder, wherein the magnetic particles have a volume average particle diameter d (μm) and an apparent density ρ (g/cm$^3$) and a roughness of the surface of the cylinder is 1/10 to 1/5 of the volume average particle diameter d;

a regulator facing the cylinder wherein a distance $D_R$ of a regulating gap between the regulator and the cylinder satisfies the following relation in terms of the minimum gap distance H: $H<D_R<1.4H$, the regulator regulating an amount of the magnetic particles on the cylinder when the magnetic brush passes the regulating gap;

the cylinder conveying the magnetic brush toward the minimum gap section so that the magnetic brush is compressed between the cylinder and the image carrying member and the compressed magnetic brush forms a nip region of 0.2 mm to 10 mm in length, wherein an amount M (g/cm$^2$) of the magnetic particles existing in the nip region satisfies a following relation: $\rho \leqq M/H \leqq 1.6\rho$, whereby the magnetic particles are packed in the nip region and the packed magnetic particles contact the image carrying member over all of the nip region;

the plural magnet poles of the magnet member being arranged such that one of the plural magnet poles is located in the nip region and downstream of the minimum gap section in terms of the rotating direction of the cylinder; and a bias device for applying a bias voltage to the magnetic brush so that the image carrying member is charged through the packed magnetic particles in the nip region, the bias voltage comprising a DC voltage component and an AC voltage component.

2. The apparatus of claim 1, wherein the magnet member has a center around which the plural magnetic poles are provided, the plural magnet poles comprising an upstream magnet pole located upstream of the regulator and a downstream magnet pole located downstream of the regulator in terms of the rotating direction of the cylinder, a line connecting a center of the upstream magnet with the center of the magnet member and a line connecting the regulator with the center of the magnet member forming an angle $\theta_1$ therebetween, and the line connecting the regulator with the center of the magnet member and a line connecting a center of the downstream magnet with the center of the magnet member forming an angle $\theta_2$, wherein a magnetic field strength of the upstream magnet is B1 (gauss) and a magnetic field strength of the downstream magnet is B2 (gauss) and wherein the angles $\theta_1$ and $\theta_2$ and the magnetic field strength B1 and B2 satisfy a following relation, $$(B1/B2\times0.8)\leqq\theta_1/\theta_2\leqq(B1/B2\times1.2).$$

* * * * *